US008529097B2

(12) United States Patent
Arik et al.

(10) Patent No.: US 8,529,097 B2
(45) Date of Patent: Sep. 10, 2013

(54) LIGHTING SYSTEM WITH HEAT DISTRIBUTION FACE PLATE

(75) Inventors: Mehmet Arik, Niskayuna, NY (US); Stanton Earl Weaver, Niskayuna, NY (US); Thomas Elliot Stecher, Niskayuna, NY (US); Glenn Howard Kuenzler, East Cleveland, OH (US); Charles Franklin Wolfe, Jr., Niskayuna, NY (US); Ri Li, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 272 days.

(21) Appl. No.: 12/908,954

(22) Filed: Oct. 21, 2010

(65) Prior Publication Data

US 2012/0098425 A1 Apr. 26, 2012

(51) Int. Cl.
*F21V 29/00* (2006.01)

(52) U.S. Cl.
USPC ..... 362/294; 362/249.02; 362/373; 362/800

(58) Field of Classification Search
USPC ..... 362/249.02, 294, 373, 800
See application file for complete search history.

(56) References Cited

U.S. PATENT DOCUMENTS

| | | | |
|---|---|---|---|
| 5,758,823 | A | 6/1998 | Glezer et al. |
| 6,109,222 | A | 8/2000 | Glezer et al. |
| 6,247,525 | B1 | 6/2001 | Smith et al. |
| 6,412,732 | B1 | 7/2002 | Amitay et al. |
| 6,588,497 | B1 | 7/2003 | Glezer et al. |
| 6,644,598 | B2 | 11/2003 | Glezer et al. |
| 7,204,615 | B2 | 4/2007 | Arik et al. |
| 7,252,140 | B2 | 8/2007 | Glezer et al. |
| 7,483,770 | B2 | 1/2009 | Meinders et al. |
| 7,543,961 | B2 | 6/2009 | Arik et al. |
| 7,556,406 | B2 | 7/2009 | Petroski et al. |
| 7,606,029 | B2 | 10/2009 | Mahalingam et al. |
| 7,607,470 | B2 | 10/2009 | Glezer et al. |
| 2006/0060331 | A1 | 3/2006 | Glezer et al. |
| 2006/0185822 | A1 | 8/2006 | Glezer et al. |
| 2006/0196638 | A1 | 9/2006 | Glezer et al. |
| 2007/0023169 | A1 | 2/2007 | Mahalingam et al. |
| 2007/0081027 | A1 | 4/2007 | Beltran et al. |
| 2007/0095987 | A1 | 5/2007 | Glezer et al. |
| 2007/0096118 | A1 | 5/2007 | Mahalingam et al. |
| 2007/0119573 | A1 | 5/2007 | Mahalingam et al. |
| 2007/0141453 | A1 | 6/2007 | Mahalingam et al. |
| 2007/0267976 | A1 | 11/2007 | Bohler et al. |
| 2007/0272393 | A1 | 11/2007 | Reichenbach et al. |
| 2008/0006393 | A1 | 1/2008 | Grimm |
| 2008/0009187 | A1 | 1/2008 | Grimm et al. |
| 2008/0043061 | A1 | 2/2008 | Glezer et al. |
| 2008/0062644 | A1 | 3/2008 | Petroski |

(Continued)

FOREIGN PATENT DOCUMENTS

| | | |
|---|---|---|
| DE | 102009020817 | 11/2009 |
| EP | 1040736 | 2/2007 |

(Continued)

*Primary Examiner* — Jason Moon Han
(74) *Attorney, Agent, or Firm* — Fletcher Yoder, P.C.

(57) ABSTRACT

Lighting systems having a light source and a thermal management system are provided. The thermal management system includes synthetic jet devices, a heat sink and a heat distribution face plate. The synthetic jet devices are arranged in parallel to one and other and are configured to actively cool the lighting system. The heat distribution face plate is configured to radially transfer heat from the light source into the ambient air.

24 Claims, 5 Drawing Sheets

(56) References Cited

U.S. PATENT DOCUMENTS

| | | | |
|---|---|---|---|
| 2008/0151541 | A1 | 6/2008 | Heffington et al. |
| 2008/0219007 | A1 | 9/2008 | Heffington et al. |
| 2008/0295997 | A1 | 12/2008 | Heffington et al. |
| 2009/0001372 | A1 | 1/2009 | Arik et al. |
| 2009/0084866 | A1 | 4/2009 | Grimm et al. |
| 2009/0109625 | A1 | 4/2009 | Booth et al. |
| 2009/0141065 | A1 | 6/2009 | Darbin et al. |
| 2009/0168343 | A1 | 7/2009 | Aarts et al. |
| 2010/0012301 | A1 | 1/2010 | Aarts |
| 2010/0014839 | A1 | 1/2010 | Benoy et al. |
| 2010/0018675 | A1 | 1/2010 | Aarts et al. |
| 2010/0033071 | A1 | 2/2010 | Heffington et al. |
| 2010/0039012 | A1 | 2/2010 | Grimm |

FOREIGN PATENT DOCUMENTS

| | | |
|---|---|---|
| EP | 1975505 | 10/2008 |
| WO | WO2008048493 | 4/2008 |
| WO | WO2008152560 | 12/2008 |
| WO | WO2009040703 | 4/2009 |
| WO | WO2009072046 | 6/2009 |
| WO | WO2010004469 | 1/2010 |
| WO | WO2010010495 | 1/2010 |

LIGHTING SYSTEM WITH HEAT DISTRIBUTION FACE PLATE

STATEMENT REGARDING FEDERALLY SPONSORED RESEARCH & DEVELOPMENT

This invention was made with Government support under contract number DE FC26-08NT01579 awarded by The United States Department of Energy. The Government has certain rights in the invention.

BACKGROUND OF THE INVENTION

The invention relates generally to lighting systems, and more particularly to lighting systems having thermal management systems.

High efficiency lighting systems are continually being developed to compete with traditional area lighting sources, such as incandescent or florescent lighting. While light emitting diodes (LEDs) have traditionally been implemented in signage applications, advances in LED technology have fueled interest in using such technology in general area lighting applications. LEDs and organic LEDs are solid-state semiconductor devices that convert electrical energy into light. While LEDs implement inorganic semiconductor layers to convert electrical energy into light, organic LEDs (OLEDs) implement organic semiconductor layers to convert electrical energy into light. Significant developments have been made in providing general area lighting implementing LEDs and OLEDs.

One potential drawback in LED applications is that during usage, a significant portion of the electricity in the LEDs is converted into heat, rather than light. If the heat is not effectively removed from an LED lighting system, the LEDs will run at high temperatures, thereby lowering the efficiency and reducing the reliability of the LED lighting system. In order to utilize LEDs in general area lighting applications where a desired brightness is required, thermal management systems to actively cool the LEDs may be considered. Providing an LED-based general area lighting system that is compact, lightweight, efficient, and bright enough for general area lighting applications is challenging. While introducing a thermal management system to control the heat generated by the LEDs may be beneficial, the thermal management system itself also introduces a number of additional design challenges.

BRIEF DESCRIPTION OF THE INVENTION

In one embodiment, a lighting system is provided. The lighting system includes a light source configured to provide area lighting and a thermal management system configured to cool the lighting system. The thermal management system comprises active and passive cooling mechanisms. The active cooling mechanisms include a plurality of synthetic jet devices. The passive cooling mechanisms include a heat distribution face plate.

In another embodiment, there is provided a lighting system comprising an array of light emitting diodes (LEDs) arranged on a surface of a lighting plate. The lighting system further comprises a thermal management system. The thermal management system includes a heat sink, a plurality of synthetic jets and a heat distribution face plate. The heat sink has a base and a plurality of fins extending therefrom. The plurality of synthetic jet devices are arranged to produce a jet stream between a respective pair of the plurality of fins. The heat distribution face plate is configured to transfer heat radially outward from the array of LEDs to the ambient air.

In another embodiment, there is provided a lighting system, comprising a light source and a heat distribution face plate. The light source comprises a plurality of illumination devices. The heat distribution face plate has an opening configured to allow the illumination devices to extend there-through. Further, the heat distribution face plate is configured to thermally conduct heat outward from the light source.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
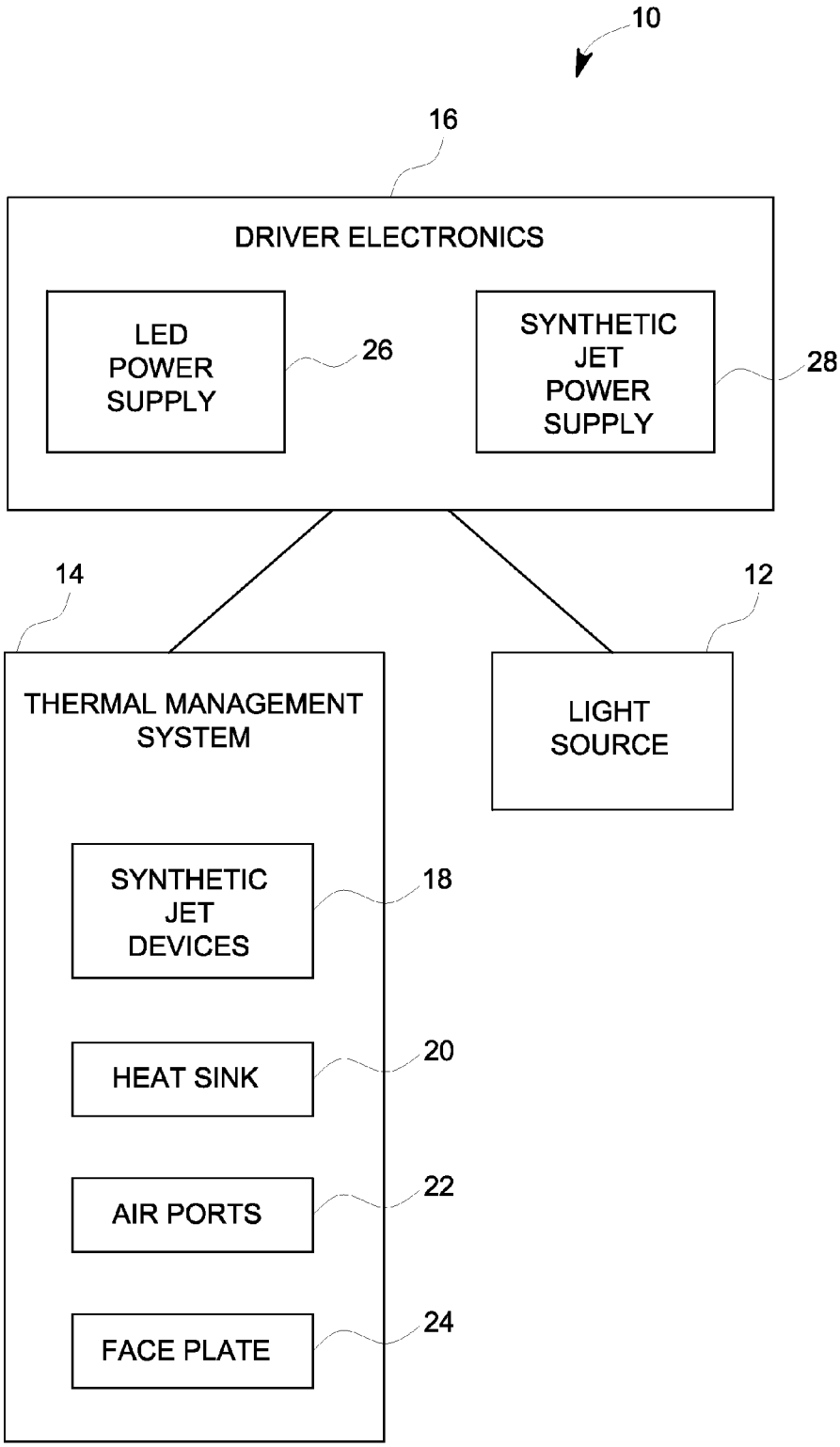
FIG. 1 is block diagram of a lighting system in accordance with an embodiment of the invention.

Embodiments of the invention generally relate to LED-based area lighting systems. A lighting system is provided with driver electronics, LED light source and a thermal management system that provides for active and passive cooling and heat distribution in the lighting system. The thermal management system includes synthetic jet devices, a heat sink, air ports and a heat distribution face plate. The face plate is arranged in thermal contact with the LED light source to allow heat removal from the lighting system through convection and radiation cooling. The heat distribution face plate may include vents formed there-through for increased air flow when the synthetic jet devices are activated. Further, the material used to form the heat distribution face plate may be selected to increase heat transfer from the lighting source into the ambient air. In one embodiment, the lighting system fits into a standard 6" (15.2 cm) halo and leaves approximately 0.5" (1.3 cm) between the lamp and halo. Alternatively, the lighting system may be scaled differently, depending on the application. The presently described embodiments provide a lighting source, which produces approximately 1500 lumens (lm) with a driver electronics efficiency of 90%, and may be useful in area lighting applications. The thermal management system allows the LED junction temperatures to remain less than 100° C. for the disclosed embodiments.

Advantageously, in one embodiment, the lighting system uses a conventional screw-in base (i.e., Edison base) that is connected to the electrical grid. The electrical power is appropriately supplied to the thermal management system and to the light source by the same driver electronics unit. In one embodiment, the LEDs of the light source are driven at 500 mA and 59.5 V while the synthetic jet devices of the thermal management system are driven with less than 200 Hz and 120 V (peak-to-peak). The LEDs provide a total of over 1500 steady state face lumens, which is sufficient for general area lighting applications. In the illustrated embodiments described below, synthetic jet devices are provided to work in conjunction with a heat sink having a plurality of fins, air ports, and the heat distribution face plate, which may include additional air vents, to both actively and passively cool the LEDs. As will be described, the synthetic jet devices are excited with a desired power level to provide adequate cooling during illumination of the LEDs.

As described further below, the synthetic jet devices are arranged vertically with regard to the lighting surface. The synthetic jet devices are arranged parallel to one another and are configured to provide sufficient air flow to cool the light source. When actuated, the synthetic jet devices provide an active cooling mechanism by which ambient air is pulled through the lighting system by the synthetic jet devices through air ports and air vents, which work in conjunction to guide the air flow unidirectionally between fins of the heat sink. In addition, the heat distribution face plate provides a passive cooling mechanism. The heat distribution face plate is arranged in thermal contact with the heat sink and/or the LED base and designed to radiate heat outwardly away from the lighting system when the LED light source is illuminated. In addition, vents in the heat distribution face plate may also provide increased air flow when the synthetic jet devices are actuated.

Referring now to FIG. 1, a block diagram illustrating a lighting system 10 in accordance with embodiments of the present invention is illustrated. In one embodiment, the lighting system 10 may be a high-efficiency solid-state down-light luminaire. In general, the lighting system 10 includes a light source 12, a thermal management system 14, and driver electronics 16 configured to drive each of the light source 12 and the thermal management system 14. The light source 12 includes a number of LEDs arranged to provide down-light illumination suitable for general area lighting. In one embodiment, the light source 12 may be capable of producing at least approximately 1500 face lumens at 75 μm/W, CRI >80, CCT=2700 k–3200 k, 50,000 hour lifetime at a 100° C. LED junction temperature. Further, the light source 12 may include color sensing and feedback, as well as being angle control.

As will also be described further below, the thermal management system 14 is configured to cool the LEDs such that the LED junction temperatures remain at less than 100° C. under normal operating conditions. In one embodiment, the thermal management system 14 includes synthetic jet devices 18, heat sinks 20, air ports 22 and a heat distribution face plate 24, which are configured to work in conjunction to provide the desired cooling and air exchange for the lighting system 10. As will be described further below, the synthetic jet devices 18 are arranged to actively pull ambient air through the lighting system 10, while the heat distribution face plate 24 is arranged to provide passive heat transfer from the light source 12 outward into the ambient air.

The driver electronics 16 include an LED power supply 26 and a synthetic jet power supply 28. In accordance with one embodiment, the LED power supply 26 and the synthetic jet power supply 28 each comprise a number of chips and integrated circuits residing on the same system board, such as a printed circuit board (PCB), wherein the system board for the driver electronics 16 is configured to drive the light source 12, as well as the thermal management system 14. By utilizing the same system board for both the LED power supply 26 and the synthetic jet power supply 28, the size of the lighting system 10 may be advantageously minimized. In an alternate embodiment, the LED power supply 26 and the synthetic jet power supply 28 may each be distributed on independent boards.

Figure 2:
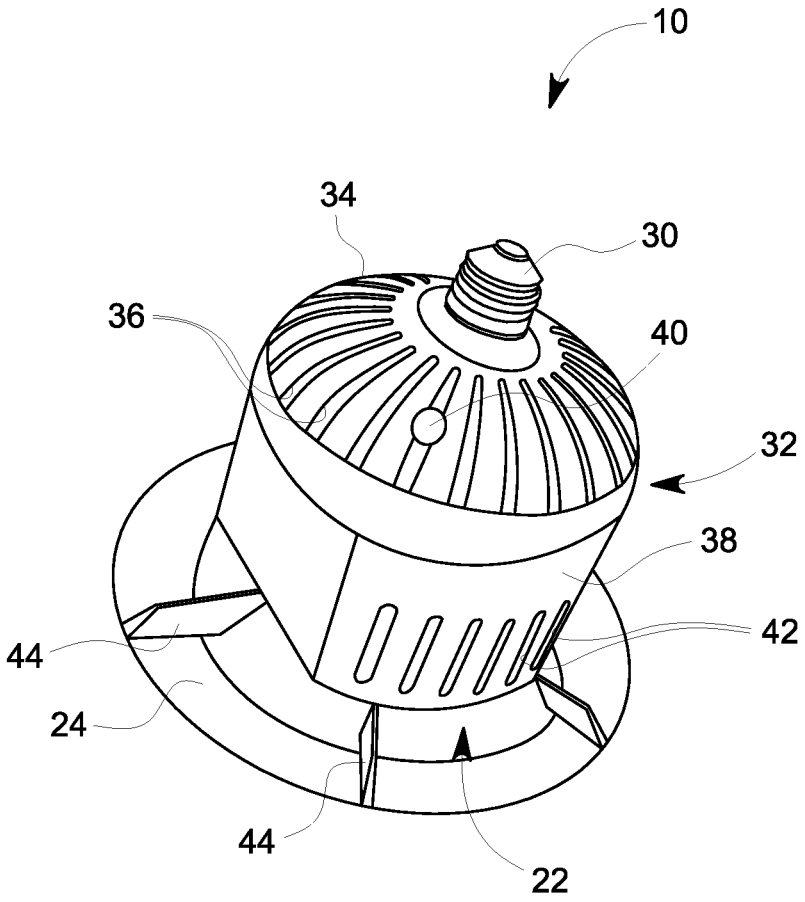
FIG. 2 illustrates a perspective view of a lighting system, in accordance with an embodiment of the invention.

Referring now to FIG. 2, a perspective view of one embodiment of the lighting system 10 is illustrated. In one embodiment, the lighting system 10 includes a conventional screw-in base (Edison base) 30 that may be connected to a conventional socket that is coupled to the electrical power grid. The system components are contained within a housing structure generally referred to as a housing structure 32. As will be described and illustrated further with regard to FIG. 3, the housing structure 32 is configured to support and protect the internal portion of the light source 12, the thermal management system 14, and the driver electronics 16.

In one embodiment, the housing structure 32 includes a cage 34, having air slots 36 there through. The cage 34 is configured to protect the electronics board having the driver electronics 16 disposed thereon. The housing structure 32 further includes a thermal management system housing 38 to protect the components of the thermal management system 14. The cage 34 may be mechanically coupled to the thermal management system housing 38, or some other portion of the lighting system 10, via screws 40. The thermal management system housing 38 many include air slots 42. In accordance with one embodiment, the thermal management system housing 38 is shaped such that air ports 22 allow ambient air to flow in and out of the lighting system 10 by virtue of synthetic jet devices in the thermal management system 14, as described further below with respect to FIG. 4.

Further, the housing structure 32 is coupled to a heat distribution face plate 24 configured to transfer heat from the light source 12 to the ambient air. The heat distribution face plate 24 may be made of a suitable thermally conductive plastic, metal or thermally loaded composite materials that may be loaded with metals, ceramics, etc. As will be appreciated, the heat distribution face plate 24 may be made from any thermally conductive high emissivity material that allow heat transfer from the heat source, here the light source 12, through the material and into the air. As will be described and illustrated further below, the shape of the distribution face plate 24 is designed such that the heat from the light source 12 is transferred from inside of the lighting system 10, outwardly toward the periphery of the heat distribution face plate 24, such that is radiates into the air. As will be described and illustrated in FIG. 3, the heat distribution face plate 24 includes an opening which is sized and shaped to allow the faces of the LEDs and/or optics, of the light source 12, to be exposed through the underside of the lighting system 10 such that when illuminated, the LEDs provide general area down-lighting. Further, as described with reference to FIG. 4, the heat distribution face plate 24 includes support spacers 44 configured to provide a sufficient gap between the heat distribution face plate 24 and the thermal management housing 38, so as not to impede the air flow path through the lighting system 10 when the synthetic jet devices 18 are actuated. In alternative embodiments illustrated and described with reference to FIG. 5, the heat distribution face plate 24 may further include vents to increase air flow through the lighting system 10 when the synthetic jet devices 18 are actuated.

Figure 3:
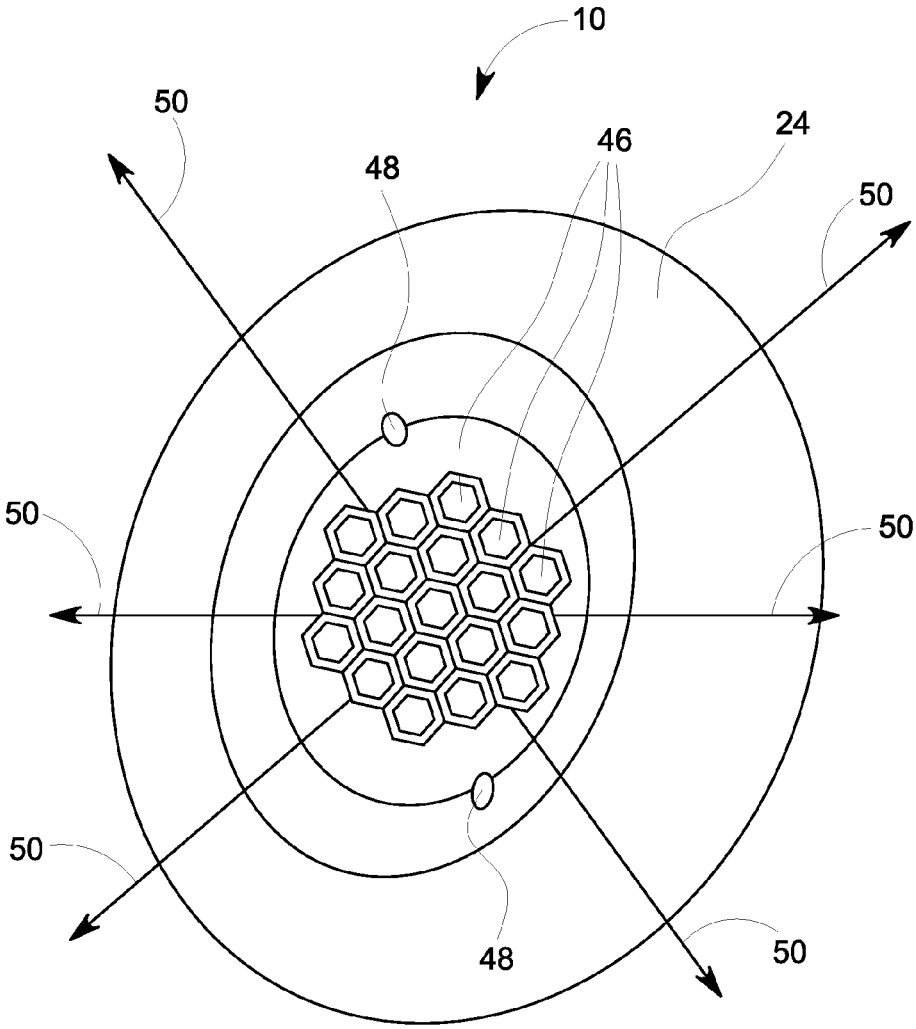
FIG. 3 illustrates a perspective view of the light source of a lighting system, in accordance with an embodiment of the invention.

Turning now to FIG. 3, a perspective view of the lighting surface of the lighting system 10 is illustrated, in accordance with an embodiment of the invention. As illustrated, the light source 12 includes a plurality of LEDs 46. In accordance with one embodiment, the light source 12 comprises 19 blue LEDs 46. The LEDs 46 are arranged to protrude through an opening in the heat distribution face plate 24. The heat distribution face plate 24 may be mechanically coupled to the lighting system 10 (e.g., to a base plate on which the LEDs 46 are arranged within the lighting system 10), via screws 48. As will be described further below with respect to FIG. 4, the arrangement of the heat distribution face plate 24 in proximity to the light source 12 and the heat sink 20 within the lighting system 10, allows for radial heat transfer from the light source 10 through the heat distribution face plate 24 and into the ambient air, as generally indicated by heat transfer lines 50. In addition to the heat transfer function of the heat distribution face plate 24, it should be noted that the heat distribution face plate 24 may also be designed to provide ornamental features that may be aesthetically pleasing to consumers.

Figure 4:
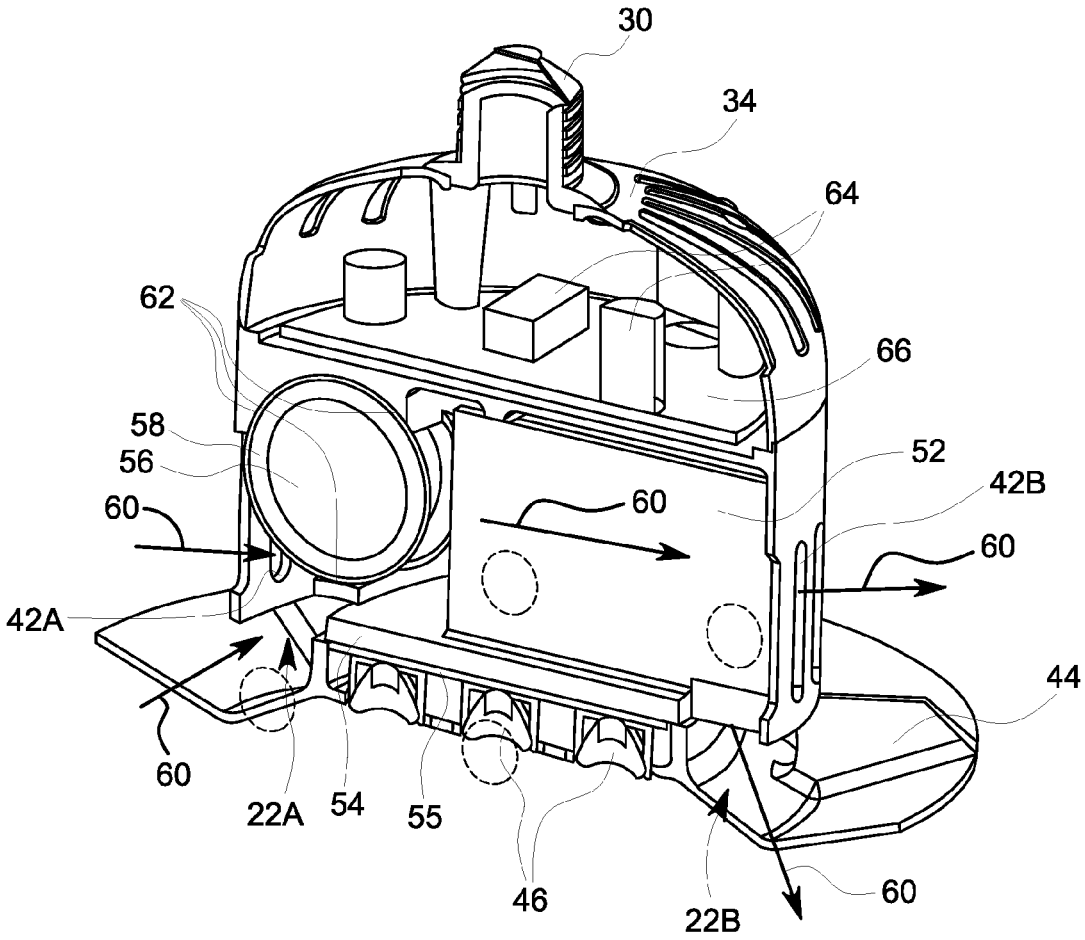
FIG. 4 illustrates a cross-sectional view of a portion of a thermal management system of a lighting system, in accordance with an embodiment of the invention.

Referring now to FIG. 4, a partial cross-sectional view of the lighting system 10 is provided to illustrate certain details of the thermal management system 18. As previously discussed, the thermal management system 14 includes synthetic jet devices 18, heat sink 20, air ports 22, and a heat distribution face plate 24. In the illustrated embodiment, the thermal management system 14 includes a heat sink 20 having a number of fins 52 coupled to a base 54 via screws. As will be appreciated, the heat sink 20 provides a heat-conducting path for the heat produced by the LEDs 46 to be dissipated. The LEDs 46 may be mounted on an LED base plate 55 using a thermally conductive interface material (TIM). The base 54 of the heat sink 20 is arranged to rest against the backside of the light source 12 (e.g., the LED base plate 55), such that heat from the LEDs 46 may be transferred to the base 54 of the heat sink 20. The fins 52 extend perpendicularly from the base 54, and are arranged to run parallel to one another.

The thermal management system 14 further includes a number of synthetic jet devices 18 which are arranged adjacent to the fins 52 of the heat sink 20. As will be appreciated, each synthetic jet device 18 is configured to provide a synthetic jet flow across the base 54 and between respective fins 58 to provide cooling of the LEDs 46. Each synthetic jet device 18 includes a diaphragm 56 which is configured to be driven by the synthetic jet power supply 26 such that the diaphragm 56 moves rapidly back and forth within a hollow frame 58 to create an air jet through an opening in the frame 58 which will be directed through the gaps between the fins 52 of the heat sink 20.

As will be appreciated, synthetic jets, such as the synthetic jet devices 18, are zero-net-massflow devices that include a cavity or volume of air enclosed by a flexible structure and a small orifice through which air can pass. The structure is induced to deform in a periodic manner causing a corresponding suction and expulsion of the air through the orifice. The synthetic jet device 18 imparts a net positive momentum to its external fluid, here ambient air. During each cycle, this momentum is manifested as a self-convecting vortex dipole that emanates away from the jet orifice. The vortex dipole then impinges on the surface to be cooled, here the underlying light source 12, disturbing the boundary layer and convecting the heat away from its source. Over steady state conditions, this impingement mechanism develops circulation patterns near the heated component and facilitates mixing between the hot air and ambient fluid.

In accordance with one embodiment, each synthetic jet devices 18 has two piezoelectric disks, excited out of phase and separated by a thin compliant wall with an orifice. This particular design has demonstrated substantial cooling enhancement, during testing. It is important to note that the synthetic jet operating conditions should be chosen to be practical within lighting applications. The piezoelectric components are similar to piezoelectric buzzer elements. The cooling performance and operating characteristics of the synthetic jet device 18 are due to the interaction between several physical domains including electromechanical coupling in the piezoelectric material used for actuation, structural dynamics for the mechanical response of the flexible disks to the piezoelectric actuation, and fluid dynamics and heat transfer for the jet of air flow. Sophisticated finite element (FE) and computational fluid dynamics (CFD) software programs are often used to simulate the coupled physics for synthetic jet design and optimization.

In the illustrated embodiment, each synthetic jet device 18 is positioned between the recesses provided by the gaps between the parallel fins 52, such that the air stream created by each synthetic jet device 18 flows through the gaps between the parallel fins 52 to cool the lighting system 10. The synthetic jet devices 18 can be powered to create a unidirectional flow of air through the heat sink 20, between the fins 52, such that air from the surrounding area is entrained into the duct through one of the ports 22A and the slots 42A on one side of the thermal management system housing 38 and warm air from the heat sink 20 is ejected into the ambient air through the other port 22B and slots 42B on the other side of the thermal management system housing 38. The unidirectional airflow into the port 22A and slots 42A, through the fin gaps, and out the port 22B and slots 42B is generally indicated by airflow arrows 60. Advantageously, the unidirectional air flow 60 prevents heat buildup within the lighting system 10, which is a leading cause for concern in the design of thermal management of down-light systems. In alternative embodiments, the air flow created by the synthetic jet devices 18 may be radial or impinging, for instance.

In addition, the thermal management system 14 advantageously provides passive cooling mechanisms, as well. For instance, the base 54 of the heat sink 20 is arranged in contact with the underlying light source 12, such that heat can be passively transferred from the LEDs 46 to the heat sink 20. The array of synthetic jet devices 18 is arranged to actively assist in the linear transfer of heat transfer, along the fins 58 of the heat sink 20.

The heat distribution face plate 24 provides yet another passive heat transfer mechanism of cooling the lighting system 10. As illustrated, the heat distribution face plate 24 is mounted in thermal contact with the base 54 of the heat sink 20, the LED base plate 55 and/or the thermal management system housing 38. The heat distribution face plate 24 is thermally conductive such that heat may be transferred from the base 54 of the heat sink 20, the LED base plate 55 and/or the thermal management system housing 38, radially into the ambient air. Further, the support spacers 44 in the illustrated embodiment are configured to abut the thermal management system housing 38, in such a way as to ensure sufficient air flow 60 in and out of the air ports 22. In alternative embodiments, the support spacers 44 may be omitted and the slots 42 in the thermal management system housing 38 may be appropriately sized to provide sufficient air flow 60 in and out of the lighting system 10 to provide adequate cooling. The presently described thermal management system 14 is capable of providing an LED junction temperature of less than 100° C. at approximately 30 W of heat generation.

The synthetic jet devices 18 should be secured within the lighting system 10 such that they provide maximum cooling effectiveness without mechanically constraining the motion of the synthetic jet. In one embodiment, the synthetic jet devices 18 may be secured within the lighting system 10 utilizing "contact point attachment" techniques. That is, each synthetic jet device 18 is secured at multiple contact points, wherein none of the contact points is greater than 10% of the circumference of the synthetic jet device 18. For instance, the illustrated embodiment provides that each synthetic jet device 18 is held in place by three contact points 62. By minimizing the contact area, the synthetic jet devices are not unnecessarily restrained within the lighting system 10.

In one embodiment, the thermal management system housing 38 includes molded slots within the housing structure 38 that are configured to engage the synthetic jet devices 18 at two contact points 62 (i.e., the upper two contact points of FIG. 4). By providing molded slots in the thermal management system housing 38, the synthetic jet devices 18 may be accurately positioned within the housing 38. To further secure the synthetic jet devices 18 within the thermal management system housing 38, a bridge 64 may be provided. The bridge 64 is configured to engage each synthetic jet device 18 at one contact point (i.e., the lower contact point of FIG. 4). Accordingly, in the present embodiment, once assembled, each synthetic jet device 18 is secured within the lighting system 10 at three contact points. Additionally, a soft gel such as silicone (not shown) may be applied to each of the three contact points 62 to reduce vibrational noise and to further affix each synthetic jet device 18 within the lighting system 10, such that the synthetic jet devices 18 do not rotate within the structure. Further, by using a mounting gel, the required holding force may be reduced.

As further illustrated in FIG. 4, the driver electronics 16 which are housed within the cage 34 include a number of integrated circuit components 64 mounted on a single board, such as a printed circuit board (PCB) 66. As will be appreciated, the PCB 66 having components mounted thereto, such as the integrated circuit components 64, forms a printed circuit assembly (PCA). Conveniently, the PCB 66 is sized and shaped to fit within the protective cage 34. In accordance with the illustrated embodiment, all of the electronics configured to provide power for the light source 12, as well as the thermal management system 14 are contained on a single PCB 66, which is positioned above the thermal management system 14 and light source 12. Thus, in accordance with the present design, the light source 12 and the thermal management system 14 share the same input power.

Figure 5:
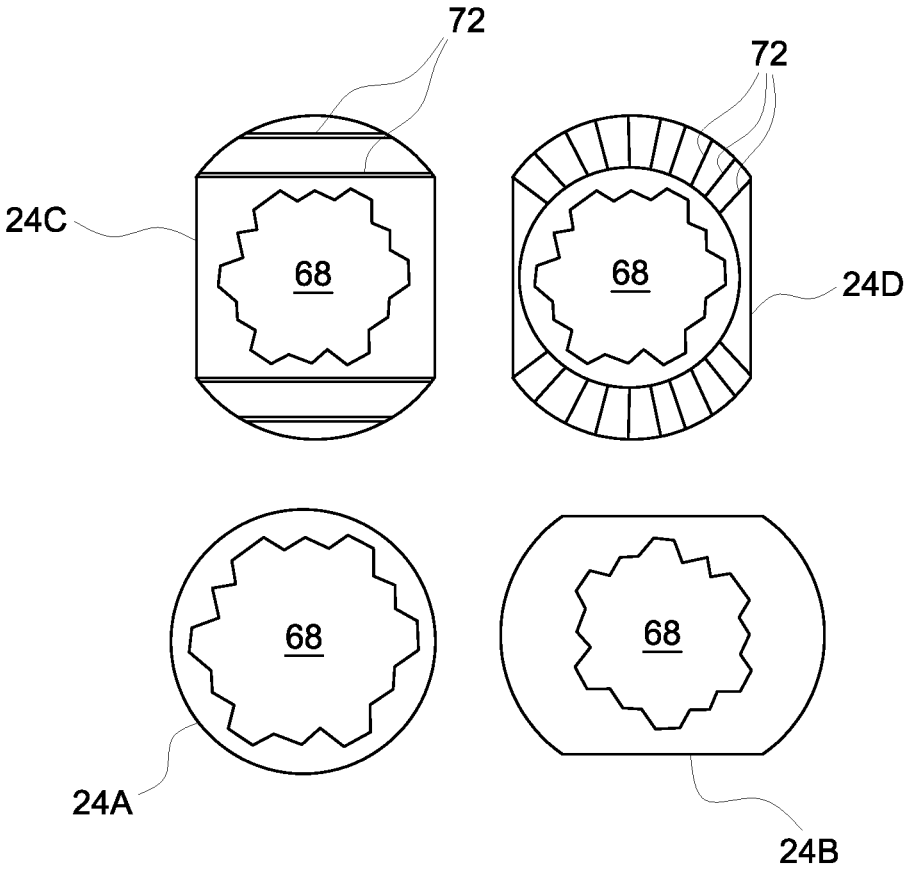
FIG. 5 illustrates a top view of alternative embodiments of the heat distribution face plate that may be incorporated into the light system, in accordance with embodiments of the invention.

As previously described, various shapes and features may be incorporated into embodiments of the heat distribution face plate 24 in accordance with embodiments of the invention. Referring now to FIG. 5, various embodiments of the heat distribution face plate 24 are illustrated. For instance, the heat distribution face plate 24A includes an opening 68 such that the underlying LEDs 46 (shown in FIGS. 3 and 4) fit through the opening 68. The heat distribution face plate 24A is circular and may be substantially similar to the embodiments illustrated in FIGS. 2-4. The heat distribution face plate 24B comprises a rectangular shape having two curved edges 70. The extended rectangular shape may provide more directed thermal distribution from the LEDs 46 outward toward the curved edges 70. In alternate embodiments, the heat distribution face plate 24 may include vents 72. The heat distribution face plates 24C and 24D include vents 72. The vents 72 may be linear segments that allow air to flow through the surface of the heat distribution face plates 24C and 24D. The vents 72 may improve air flow through the lighting system 10. As will be appreciated, the angle of the vents 72 may be optimized to provide maximum air flow directly to the light source 12.

Advantageously, the cooling techniques provided herein may be utilized to manufacture lighting systems with LEDs that exhibit lower the junction temperatures. The lower junction temperatures of the LEDs 46, may enable higher drive currents to be utilized, and thus allow for the reduction in number of LEDs 46 used to produce the same lumen output as a device having a lower drive current.

This written description uses examples to disclose the invention, including the best mode, and also to enable any person skilled in the art to practice the invention, including making and using any devices or systems and performing any incorporated methods. Further details regarding the driver electronics and the light source may be found in U.S. patent application Ser. No. 12/711,000, entitled LIGHTING SYSTEM WITH THERMAL MANAGEMENT SYSTEM, which was filed on Feb. 23, 2010 and is assigned to General Electric Company, and is hereby incorporated by reference herein. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A lighting system, comprising:

a light source configured to provide area lighting;

a thermal management system configured to cool the lighting system and comprising active and passive cooling mechanisms, wherein the active cooling mechanisms comprise a plurality of synthetic jet devices and wherein the passive cooling mechanisms comprise a heat distribution face plate and a heat sink; and driver electronics configured to provide power to each of the light source and the thermal management system.

2. The lighting system, as set forth in claim 1, wherein the light source comprises at least one light emitting diode (LED).

3. The lighting system, as set forth in claim 1, wherein the plurality of fins provide a plurality of air gaps there between.

4. The lighting system, as set forth in claim 3, wherein each of the plurality of synthetic jet devices is arranged to produce a unidirectional air flow path through one of the respective air gaps between each of the plurality of fins.

5. The lighting system, as set forth in claim 3, wherein the heat distribution face plate is arranged in thermal contact with the base portion of the heat sink.

6. The lighting system, as set forth in claim 1, wherein the light source comprises a thermally conductive base plate having a plurality of light emitting diodes mounted thereon, and wherein heat distribution face plate is in thermal contact with the thermally conductive base plate.

7. The lighting system, as set forth in claim 1, comprising a housing structure surrounding the driver electronics and the plurality of synthetic jet devices, wherein the heat distribution face plate is in thermal contact with the housing structure.

8. The lighting system, as set forth in claim 1, wherein the heat distribution face plate comprises one of a metal, a thermally conductive plastic, a thermally loaded composite or combinations thereof.

9. The lighting system, as set forth in claim 1, comprising a housing structure, and wherein the heat distribution face plate extends beyond a periphery of the housing structure.

10. The lighting system, as set forth in claim 9, wherein the heat distribution face plate comprises a circular shape.

11. The lighting system, as set forth in claim 9, wherein the heat distribution face plate comprises a rectangular shape having two curved edges.

12. The lighting system, as set forth in claim 9, wherein the heat distribution face plate comprises support spacers arranged in contact with the housing structure and configured to provide an air gap to allow ingress and egress of ambient air through the lighting system when the plurality of synthetic jet devices is actuated.

13. The lighting system, as set forth in claim 1, wherein the thermal management system comprises air ports to provide ingress and egress of ambient air through the lighting system when the plurality of synthetic jet devices is actuated.

14. The lighting system, as set forth in claim 1, wherein the thermal management system comprises slots in a housing structure to provide ingress and egress of ambient air through the lighting system when the plurality of synthetic jet devices is actuated.

15. The lighting system, as set forth in claim 1, wherein each of the plurality of synthetic jet devices is secured within a housing structure by three contact points.

16. The lighting system, as set forth in claim 1, wherein the driver electronics comprise a light emitting diode (LED) power supply and a synthetic jet power supply.

17. The lighting system, as set forth in claim 1, wherein the lighting system comprises a screw-based structure configured to electrically couple the lighting system to a standard socket.

18. The lighting system, as set forth in claim 1, wherein the lighting system is configured to produce at least approximately 1500 lumens.

19. A lighting system, comprising:

an array of light emitting diodes (LEDs) arranged on a surface of a lighting plate; and a thermal management system comprising:

a heat sink having a base and a plurality of fins extending therefrom;

a plurality of synthetic jet devices, wherein each of the plurality of synthetic jet devices is arranged to produce a jet stream between a respective pair of the plurality of fins; and a heat distribution face plate configured to transfer heat radially outward from the array of LEDs to the ambient air.

20. The lighting system, as set forth in claim 19, wherein the heat distribution face plate is arranged in thermal contact with the base of the heat sink.

21. The lighting system, as set forth in claim 19, wherein the heat distribution face plate is arranged in thermal contact with the lighting plate.

22. The lighting system, as set forth in claim 19, comprising a housing structure, wherein the heat distribution face plate is arranged in thermal contact with the housing structure.

23. The lighting system, as set forth in claim 22, wherein the heat distribution face plate comprises support spacers arranged in contact with the housing structure and configured to provide an air gap to allow ingress and egress of ambient air through the lighting system when the plurality of synthetic jet devices is actuated.

24. The lighting system, as set forth in claim 19, wherein the heat distribution face plate is thermally conductive.

* * * * *

UNITED STATES PATENT AND TRADEMARK OFFICE

CERTIFICATE OF CORRECTION

PATENT NO. : 8,529,097 B2
APPLICATION NO. : 12/908954
DATED : September 10, 2013
INVENTOR(S) : Arik et al.

It is certified that error appears in the above-identified patent and that said Letters Patent is hereby corrected as shown below:

In the Claims

In Column 8, Lines 28-29, in Claim 1, delete "a heat distribution face plate and a heat sink; and" and insert -- a heat distribution face plate and a heat sink, wherein the heat distribution face plate comprises vents there-through, wherein the heat sink comprises a base portion and a plurality of fins extending from the base portion; and --, therefor.

In Column 10, Lines 8-9, in Claim 19, delete "the array of LEDs to the ambient air." and insert -- the array of LEDs to the ambient air, wherein the heat distribution face plate comprises a plurality of vents configured to provide an air gap to allow ingress and egress of ambient air through the lighting system when the plurality of synthetic jet devices is actuated. --, therefor.

Signed and Sealed this
Third Day of February, 2015

Michelle K. Lee

Michelle K. Lee
*Deputy Director of the United States Patent and Trademark Office*